US006637423B1

(12) United States Patent
Rettenweber et al.

(10) Patent No.: US 6,637,423 B1
(45) Date of Patent: Oct. 28, 2003

(54) CUTTING DEVICE WITH CHANGEABLE CUTTING DEPTH

(75) Inventors: Alfred Rettenweber, München (DE); Alexander Türner, Erding-Pretzen (DE); Peter Heubeck, Ilm-Münster (DE); Rochus Gold, Freising (DE); Jürgen Röming, Oberschleissheim (DE); Georg Strigl, Reichertshofen (DE)

(73) Assignee: Wacker Construction Equipment AG, Munich (DE)

( * ) Notice: Subject to any disclaimer, the term of this patent is extended or adjusted under 35 U.S.C. 154(b) by 10 days.

(21) Appl. No.: 10/048,729

(22) PCT Filed: Jul. 28, 2000

(86) PCT No.: PCT/EP00/07319

§ 371 (c)(1),
(2), (4) Date: Jan. 30, 2002

(87) PCT Pub. No.: WO01/12904

PCT Pub. Date: Feb. 22, 2001

(30) Foreign Application Priority Data

Aug. 11, 1999 (DE) ..... 299 13 982 U

(51) Int. Cl.[7] ..... B24B 23/00
(52) U.S. Cl. ..... 125/13.01; 125/14; 451/360
(58) Field of Search ..... 125/13.01, 13.03, 125/14, 20; 451/69, 177, 359, 360

(56) References Cited

U.S. PATENT DOCUMENTS

| | | | | |
|---|---|---|---|---|
| 3,357,745 A | * 12/1967 | Cooper | ..... | 299/39.3 |
| 4,840,431 A | * 6/1989 | Jedick | ..... | 299/39.3 |
| 4,953,523 A | * 9/1990 | Swan | ..... | 125/14 |
| 5,690,391 A | * 11/1997 | Kingsley et al. | ..... | 299/39.3 |
| 5,810,448 A | * 9/1998 | Kingsley et al. | ..... | 299/39.3 |

FOREIGN PATENT DOCUMENTS

| | | | | |
|---|---|---|---|---|
| DE | 88 15 780.6 | 3/1989 | ..... | E01C/23/09 |
| GB | 2256613 A | * 12/1992 | ..... | B28D/1/04 |

* cited by examiner

*Primary Examiner*—Joseph J. Hail, III
*Assistant Examiner*—David B. Thomas
(74) *Attorney, Agent, or Firm*—Boyle Fredrickson Newholm Stein & Gratz S.C.

(57) ABSTRACT

The invention relates to a cutting device that is provided with a traveling mechanism and a cutting disc that can be rotatably driven by a drive unit. The drive unit and the cutting disc are arranged on a support frame. An undercarriage is movably fixed to the support frame. A relative position can be adjusted between the undercarriage and the support frame by means of an adjustment device. The adjustment device is provided with a coarse adjustment device for adjusting at least two discrete relative positions and a fine adjustment device, which overlaps the effect of the coarse adjustment device in at least one of the discrete relative positions. The fine adjustment device is used for adjusting any relative position in a determined area.

18 Claims, 2 Drawing Sheets

CUTTING DEVICE WITH CHANGEABLE CUTTING DEPTH

BACKGROUND OF THE INVENTION

1. Field of the Invention

This invention relates to a cutting apparatus, in particular a flat saw, with variable cutting depth.

2. Description of the Related Art

Flat saws—such as, for example, of the type BFS 100 from Wacker-Werke—are used for producing joints in hardened concrete, asphalt, tiles, etc. For this purpose, a diamond-set cutting disc, for example, is rotationally driven by a drive which is fastened on a chassis and thus can easily be moved over the subsurface into which the joint is to be cut. In the process, the cutting depth, i.e. the depth with which the cutting disc penetrates into the material to be worked, must be capable of being set with great precision in order to obtain a joint having a desired cross section.

For this purpose, flat saws having chassis are known in which a front wheel axis is fastened to a link pivotable relative to the main frame. Since the front wheels are located in the vicinity of the cutting disc, variable plunging of the cutting disc into the material to be cut is obtained by a pivoting movement of the link.

For the adjustment of the link, i.e. for the adjustment of the relative movement between the main frame and the link, two methods are known on the one hand, the link can be pivoted relative to the main frame by means of a spindle actuated by hand crank. Alternatively, a lever linkage with latching can be provided.

In the first solution, a relatively high setting accuracy with small operating forces can be achieved. However, in order to lift out the cutting disc or plunge it in, numerous turns of the hand crank are necessary, which increases the working time. The setting and repetitive accuracy also depends on the care of the operator, who has to count the number of crank turns or take corresponding readings.

The second solution, on account of the discrete latching positions, offers good repetitive accuracy and rapid lifting or plunging of the cutting disc. On account of the predetermined latching positions, however, the setting possibilities are limited, so that joints having any desired cutting depth cannot be produced. In addition, it is often a problem for the user in aggravated environmental conditions to find the desired latching position.

U.S. Pat. No. 4,953,523 discloses a cutting apparatus according to the preamble of Patent claim 1. Furthermore, this cutting apparatus has a quick-unlocking mechanism which is in engagement with the fine-adjustment device in a releasable manner. When the quick-unlocking mechanism is triggered, the cutting disc is set back into a transport position by the effect of a pneumatic spring.

OBJECTS AND SUMMARY OF THE INVENTION

The object of the invention is to specify a cutting apparatus in which the disadvantages known from the prior art can be avoided.

The object is achieved according to the invention by a cutting apparatus having the features of Patent claim 1. Advantageous developments of the invention can be gathered from the dependent claims.

A cutting apparatus according to the invention, in particular a flat saw, has travel gear for moving the cutting apparatus on a subsurface, a cutting disc which can be rotationally driven by a drive, a supporting frame supporting the cutting disc and the drive, an underframe fastened to the supporting frame in a movable manner and supporting at east at least one part of the travel gear, and an adjusting arrangement for adjusting the relative position of underframe and supporting frame, the adjusting arrangement having a fine-adjustment device for adjusting any desired relative positions within a certain region, and the adjusting arrangement having a coarse-adjustment device for adjusting at least two discrete relative positions and the fine-adjustment device superimposing the effect of the coarse-adjustment device in at least one of the discrete relative positions.

The advantages of the two known arrangements are therefore combined by the invention. In principle, the cutting-depth setting is effected by the coarse-adjustment device, which, however, expediently has only two latching positions, namely a transport position, in which the cutting disc does not engage in the material to be cut, and a cutting position. In the cutting position, the effect of the fine-adjustment device comes to bear, by means of which the cutting disc can be set precisely to the desired cutting depth.

Due to the fact that only two discrete relative positions are possible for the coarse-adjustment device, operating errors due to inadvertent setting of intermediate positions can be avoided. If the fine-adjustment device has been set once merely at the start of an operation, a high repetitive accuracy of the cutting depth, even if work is interrupted repeatedly, can be achieved solely by subsequent actuation of the coarse-adjustment device. Very quick lifting and plunging of the cutting disc is possible by means of the coarse-adjustment device.

In a preferred embodiment of the invention, the underframe is pivotable relative to the supporting frame and supports a part of the travel gear. In particular, the underframe supports a front axle of the travel gear, whereas the supporting frame holds the rear axle of the travel gear. As a result, the entire frame can be made very light and compact.

If the fine-adjustment device also superimposes the effect of the coarse-adjustment device in the transport position, the cutting depth can already be preset by means of a corresponding indicating device or scale without it being necessary for the cutting disc to have penetrated into the material to be cut.

In a preferred embodiment of the invention, the coarse-adjustment device is formed by a latching device and the fine-adjustment device is formed by a spindle device. As a result, the requirements with regard to robustness on the one hand the precision on the other hand can be optimally fulfilled.

It is especially advantageous in this case if the spindle device carries the latching means or latching elements of the latching device, since the effects of the coarse- and fine-adjustment devices can readily be superimposed as a result.

Another advantageous development of the invention has a spring device which prestresses the underframe relative to the supporting frame and by means of which the operator can adjust the coarse-adjustment device between the discrete relative positions with relatively small operating forces.

BRIEF DESCRIPTION OF THE DRAWING

These and further advantages and features of the invention are explained in more detail below with reference to the accompanying figures, in which

FIG. 1 shows a flat saw in a schematic side view, a drive known per se for a cutting disc 1 not being shown for the sake of clarity. The cutting disc 1 is merely shown schematically and is held together with the drive by the guide carriage 2 (shown in FIG. 1) in such a way that at least its underside can be brought into contact with the material to be cut (concrete or asphalt) (not shown).

DETAILED DESCRIPTION OF THE PREFERRED EMBODIMENTS

Figures 1, 2:
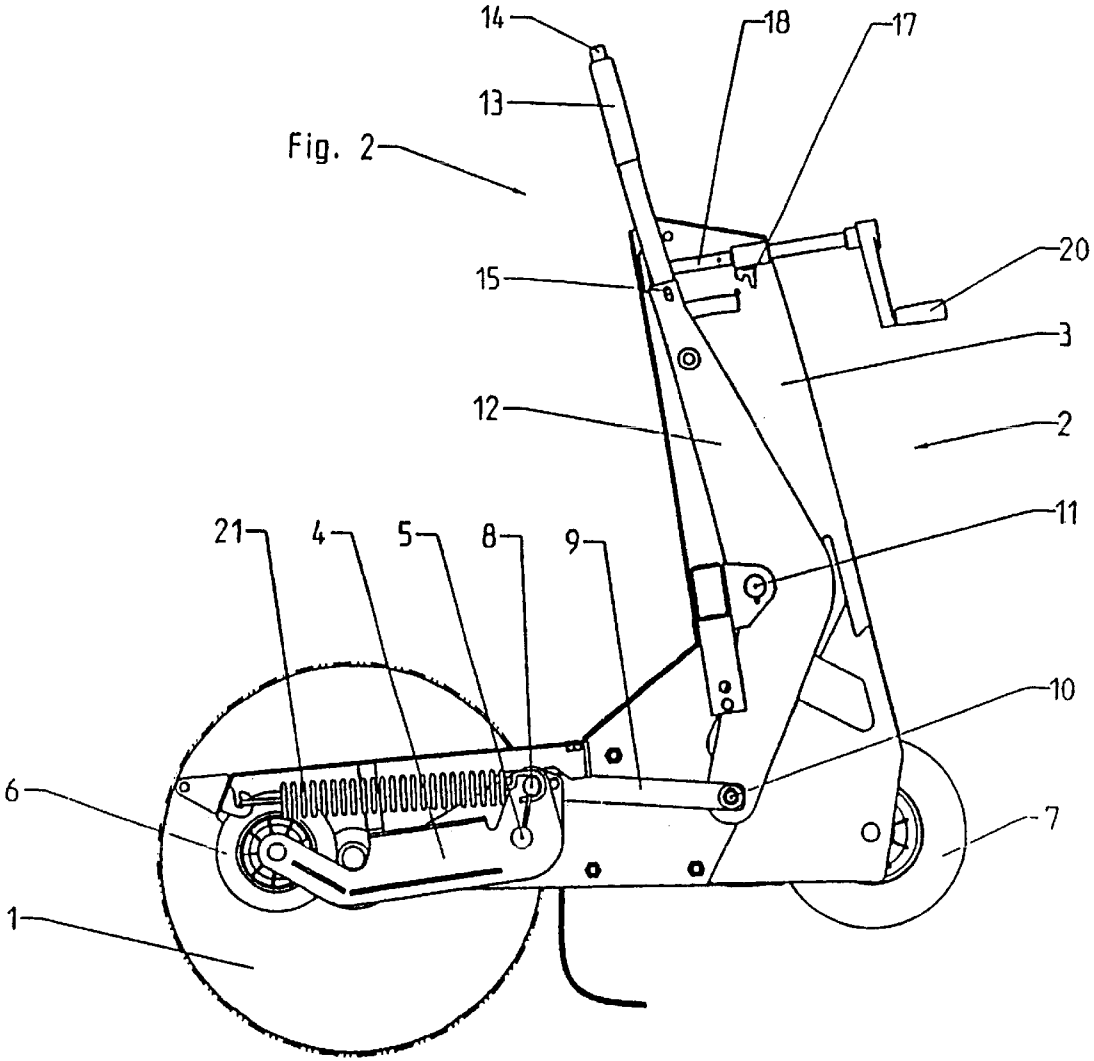
FIG. 1 shows a schematic side view of a cutting apparatus according to the invention.
FIG. 2 shows an enlarged detail of FIG. 1.
Figure 2:
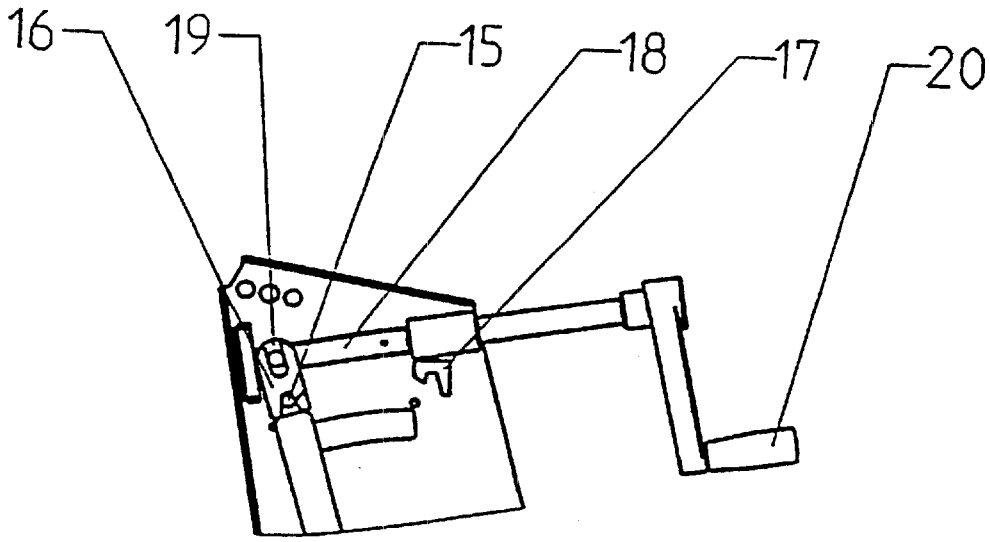

The guide carriage 2 has a supporting frame 3, on which a link 4 serving as underframe is held on a pivot 5. At its front end, the link 4 carries a front wheel axle, on which one or more front wheels 6 are held in a rotatable manner. Rear wheels 7 are provided on the supporting frame 3 in a corresponding manner.

In another embodiment (not shown) of the invention, the underframe carries the entire travel gear, that is to say the front wheels 6 and the rear wheels 7. The supporting frame is then reduced to an arm or a retaining frame into which the drive with the cutting disc 1 can be inserted. However, the relative mobility between the supporting frame and the underframe is still provided for.

In the exemplary embodiment shown, the link 4 can be moved downwards out of the supporting frame 3 via a lever mechanism.

The lever mechanism comprises a swivel joint 8 which is fastened to the link 4 and on which a slide 9 acts, the other end of this slide being connected via a swivel joint 10 to a lever 12 held on the supporting frame 3 in a pivotable manner at a pivot 11.

This lever mechanism can be pivoted between two end positions. One end position corresponds to the cutting position shown in FIG. 1, in which the link 4 is swung in or the cutting disc 1 is lowered. To reach the second end position, namely the transport position, the lever 12 must be pulled rearwards, that is to the right in the figure, by the operator at a handle 13, as a result of which the link 4 is swung out of the supporting frame 3 about the pivot 5 by the effect of the lever mechanism. As a result, the distance critical for the cutting depth between a base plane defined by the location surface of the wheels 6, 7 and an apex point of the cutting disc 1 decreases, so that the cutting disc 1 is lifted out of the material to be cut.

A coarse-adjustment device which comprises a latching device provided in the vicinity of the handle 13 is provided in order to fix the two end positions. The latching device has a latching pin 15 (also shown in FIG. 2) which can be actuated via a pushbutton 14 on the handle 13. To engage the latching pin 15, a holding element is provided in each of the two end positions, namely a latching element 16 for defining the cutting position and a latching element 17 for defining the transport position.

For the fine adjustment of the cutting depth, the position of the latching element 16 for the cutting position can be changed by means of a spindle 18 serving as a fine-adjustment device. For this purpose, the latching element 16 is formed on a spindle nut 19 movable on the spindle 18.

The spindle 18 is driven via a hand crank 20, so that the operator can easily set the position of the latching element 16 and thus ultimately the position of the link 4 and the cutting depth very precisely.

To release the cutting position, the operator presses the pushbutton 14, as a result of which the latching pin 15 is moved out of the recess on the latching element 16. The operator can then pull the handle 13 to the rear and finally allow the latching pin 15 to engage in the rear latching element 17 for the transport position.

In the embodiment shown here, the rear latching element 17 is fastened to the supporting frame 3 in a fixed position. In another embodiment of the invention, however, the latching element 17 for the transport position is likewise fastened to a further spindle nut, so that its position likewise changes during rotation of the spindle 18. This makes it possible for the effects caused by the actuation of the spindle by the operator to be observed by the operator even in the transport position, that is with the cutting disc 1 lifted. For this purpose, an indicating device can be provided if need be, it being possible for the effects of the setting by the operator to be read off from this indicating device by the operator, which considerably facilitates a presetting of the cutting depth.

Another way of facilitating a presetting is by means of a tension spring 21 which pivots the link 4 relative to the supporting frame 3 in the direction of the transport position. At least some of the weight of the guide carriage 2, the cutting disc 1 and the drive is therefore carried by the tension spring 21, this weight having to be lifted during the transfer from the cutting position into the transport position.

The set cutting depth can easily be read off if one of the elements which can be moved for setting the cutting depth carries a pointer which is displaceable over a fixed scale arranged, for example, on the supporting frame 3. The pointer may be arranged, for example, on the lever 12 or the front latching element 16.

We claim:

1. Cutting apparatus, comprising:

a travel gear for moving the cutting apparatus on a subsurface;

a cutting disc which can be rotationally driven by a drive;

a supporting frame supporting the drive with the cutting disc;

an underframe which is fastened to the supporting frame in a movable manner and supports at least one part of the travel gear; and an adjusting arrangement for adjusting the relative position of the underframe and the supporting frame, the adjusting arrangement having a fine-adjustment device for adjusting the desired relative position within a certain region; and a coarse-adjustment device for adjusting bi-directionally between at least two discrete relative positions, wherein the fine-adjustment device superimposes the effect of the coarse-adjustment device in at least one of the discrete relative positions.

2. The cutting apparatus according to claim 1, wherein the underframe is pivotable relative to the supporting frame about a horizontal axis relative to the subsurface and thus can be brought into different vertical positions relative to the subsurface.

3. The cutting apparatus according to claim 1, wherein the underframe supports the travel gear.

4. The cutting apparatus according to claim 1, wherein the supporting frame supports a part of the travel gear.

5. The cutting apparatus according to claim 1, wherein the coarse-adjustment device serves to fix a transport position and a cutting position.

6. The cutting apparatus according to claim 5, wherein the fine-adjustment device is effective at least in the cutting position.

7. The cutting apparatus according to claim 1, wherein the coarse-adjustment device has a latching device.

8. The cutting apparatus according to claim 1, wherein the fine-adjustment device has a spindle device.

9. The cutting apparatus according to claim 7, wherein the fine-adjustment device has a spindle device that carries at least one latching element of the latching device.

10. The cutting apparatus according to claim 1, wherein the position of the underframe is prestressed relative to the supporting frame by a spring device.

11. A cutting apparatus comprising:

a travel gear for moving the cutting apparatus on a subsurface;

a cutting disc which can be rotationally driven by a drive;

a supporting frame supporting the drive with the cutting disc;

an underframe which is fastened to the supporting frame in a movable manner and supports at least one part of the travel gear; and an adjusting arrangement for adjusting the relative position of the underframe and the supporting frame, the adjusting arrangement having:

a coarse-adjustment device configured to selectively fix the relative position in a transport position and a cutting position; and a fine-adjustment device configured to adjust the selectively fixed relative position within a certain region;

wherein the fine-adjustment device superimposes the effect of the coarse-adjustment device in at least one of the transport position and the cutting position.

12. The cutting apparatus according to claim 11, wherein the cutting apparatus comprises a flat saw.

13. A cutting apparatus comprising:

a travel gear for moving the cutting apparatus on a subsurface;

a cutting disc which can be rotationally driven by a drive;

a supporting frame supporting the drive with the cutting disc;

an underframe which is fastened to the supporting frame in a movable manner and supports at least one part of the travel gear; and an adjusting arrangement for adjusting the relative position of the underframe and the supporting frame, the adjusting arrangement having:

a coarse-adjustment device configured to selectively fix the relative position in a transport position and a cutting position; and a fine-adjustment device configured to adjust the selectively fixed relative position within a certain region;

wherein the fine-adjustment device superimposes the effect of the coarse-adjustment device in at least one of the transport position and the cutting position.

14. The cutting apparatus according to claim 13, wherein the cutting apparatus comprises a flat saw.

15. A method comprising:

providing a cutting apparatus having 1) a supporting frame supporting a cutting disc which can be rotationally driven by a drive and 2) an underframe which is fastened to the supporting frame in a movable manner and which supports at least one part of a travel gear for moving a cutting apparatus on a subsurface;

selectively adjusting a cutting depth of the cutting apparatus by:

selectively operating a coarse-adjustment device to move the underframe and supporting frame relative to one another between a transport position in which the cutting disc is spaced from a surface to be cut and a discrete cutting position in which the cutting disc engages and cuts the surface to be cut, the coarse-adjustment device being operable to relatively move the underframe and supporting frame bi-directionally between the transport position and the cutting position, and selectively operating a fine-adjustment device to effect additional relative movement between the underframe and the supporting frame, wherein the effects of the fine-adjustment device are superimposed on the effects of the coarse-adjustment device in at least one of the transport position and the cutting position.

16. The method of claim 15, further comprising latching the coarse-adjustment device in a selected one of the transport position and the cutting position after each coarse adjustment.

17. The method of claim 15, further comprising prestressing the position of the underframe relative to the supporting frame.

18. The method of claim 15, further comprising presetting a cutting depth of the cutting disc prior to the cutting disc penetrating the subsurface.

* * * * *